US005530207A

United States Patent [19]

Dölling

[11] Patent Number: 5,530,207

[45] Date of Patent: Jun. 25, 1996

[54] APPARATUS FOR MAKING DRAWINGS ON A SHEET-LIKE DRAWING CARRIER, FOR EXAMPLE A SHEET OF TRANSPARENT PAPER, BY MEANS OF A DEVICE FOR PRODUCING POINTS, LINES OR THE LIKE, SUCH AS A PEN OR PENCIL OR A PAIR OF COMPASSES

[76] Inventor: Bernd Dölling, Löwengasse 6, W-7760 Radolfzell, Germany

[21] Appl. No.: 952,581

[22] Filed: Sep. 28, 1992

[30] Foreign Application Priority Data

Oct. 4, 1991 [DE] Germany ..... 41 32 940.6

[51] Int. Cl.[6] ..... G08C 21/00; B43L 9/00

[52] U.S. Cl. ..... 178/18; 33/27.1

[58] Field of Search ..... 178/18, 19, 20; 33/1 M, 27.01, 27.02, 27.03, 27.04, 434, 435; 345/179

[56] References Cited

U.S. PATENT DOCUMENTS

| | | | |
|---|---|---|---|
| 3,665,102 | 5/1972 | Townsend et al. | 178/18 |
| 3,684,828 | 8/1972 | Maher | 178/18 |
| 4,500,749 | 2/1985 | Khoshnevis | 178/18 |
| 4,506,336 | 3/1985 | Hird | 178/18 |
| 4,514,688 | 4/1985 | Whetstone | 178/18 |
| 4,561,183 | 12/1985 | Shores | 178/18 X |
| 4,575,581 | 3/1986 | Langberg | 178/18 |
| 4,577,057 | 3/1986 | Blesser | 178/19 |
| 4,580,007 | 4/1986 | Searby et al. | 178/18 |
| 4,791,249 | 12/1988 | Santoro | 178/18 |
| 4,818,827 | 4/1989 | Ipcinski et al. | 178/18 |
| 4,843,719 | 7/1989 | Straten | 33/27.02 |
| 4,973,800 | 11/1990 | Sindeband et al. | 178/18 |
| 5,019,865 | 5/1991 | Tanaka et al. | 178/18 |
| 5,023,408 | 6/1991 | Murakami | 178/19 |
| 5,120,906 | 6/1992 | Protheroe | 178/18 |
| 5,193,284 | 3/1993 | Lin | 33/27.03 |
| 5,231,381 | 7/1993 | Duwear | 178/19 |
| 5,240,338 | 8/1993 | Jye | 33/27.03 |

*Primary Examiner*—Stephen Chin
*Assistant Examiner*—Kevin Kim
*Attorney, Agent, or Firm*—Bachman & LaPointe

[57] ABSTRACT

An apparatus for making drawings on a drawing carrier, for example a sheet of transparent paper, via a device for producing points or lines such as a pen or pencil, including a drawings surface which temporarily accommodates the drawings carrier and which is variable with respect to inclination relative to a support surface. The apparatus also includes a drawing aid in the form of a template which is displaceable over the drawing surface wherein the drawing aid is connected to a data receiving machine and is adapted to be activated by the pen for outputting data to the data receiving machine. The drawing aid may have at least one digitization plane associated therewith wherein data transfer can be activated at the meeting point between the drawing aid and the pen or the like.

26 Claims, 10 Drawing Sheets

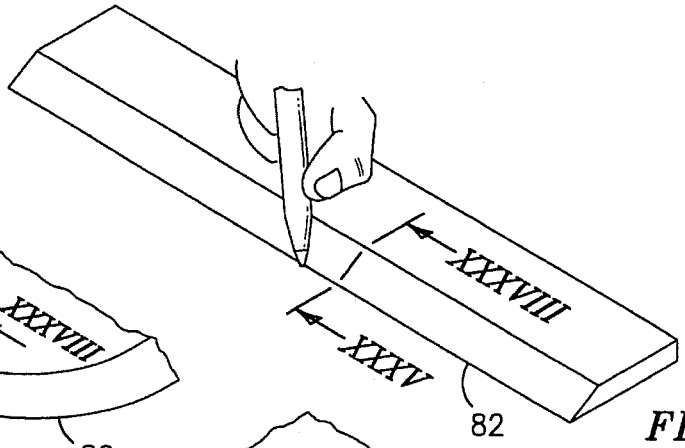
FIG. 33
FIG. 33a
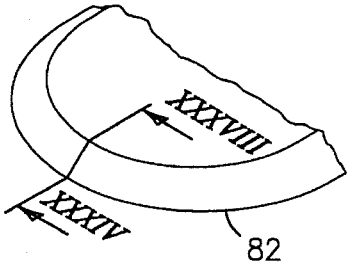
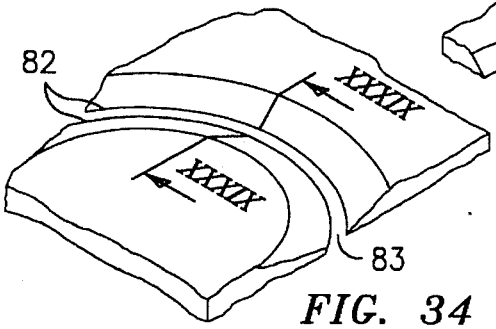
FIG. 34
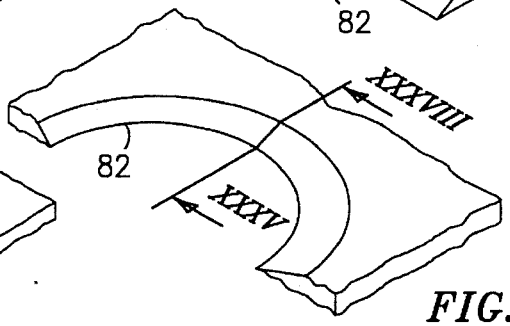
FIG. 33b
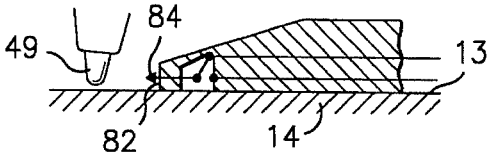
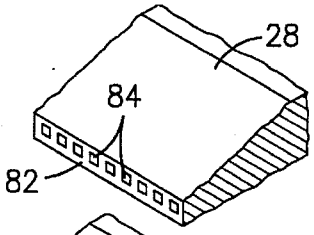
FIG. 35
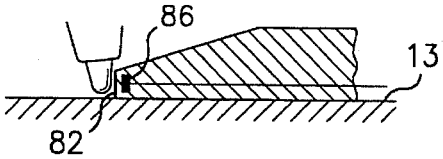
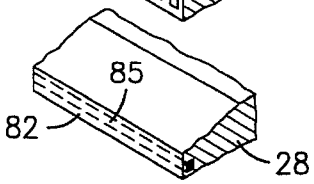
FIG. 36
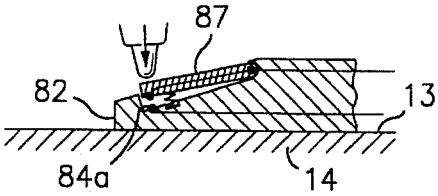
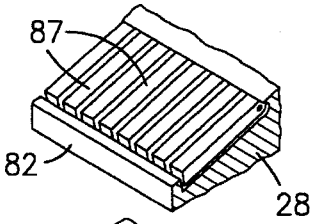
FIG. 37
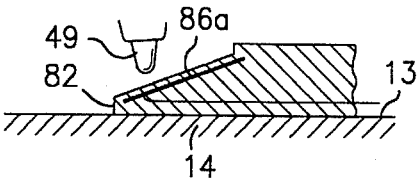
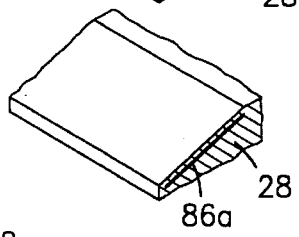
FIG. 38
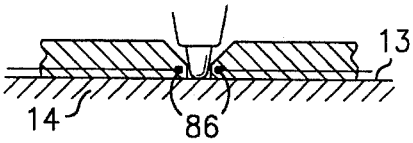
FIG. 39
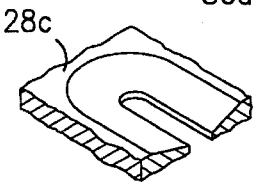
FIG. 40

APPARATUS FOR MAKING DRAWINGS ON A SHEET-LIKE DRAWING CARRIER, FOR EXAMPLE A SHEET OF TRANSPARENT PAPER, BY MEANS OF A DEVICE FOR PRODUCING POINTS, LINES OR THE LIKE, SUCH AS A PEN OR PENCIL OR A PAIR OF COMPASSES

FIELD OF THE INVENTION

BACKGROUND OF THE INVENTION

The invention relates to an apparatus for making drawings, for example drawings on a sheet-like drawing carrier, such as a sheet of transparent paper, by means of a device for producing points, lines or the like, such as a pen or pencil or a pair of compasses, comprising a drawing surface of a board or the like, which temporarily accommodates the drawing carrier and which is variable in particular in respect of its inclination relative to a support surface, and which is provided with a drawing aid which is displaceable over its surface, in the form of a ruler or the like.

Such apparatuses have long been known in the form of drawing machines with an inclinable drawing board and rulers which are carried movably thereon. The latter are fixed for example to carriages which can slide along an edge of the board and which possibly themselves in turn guide templates or the like. Accessory equipment for such drawing machines are also high-speed drawing heads which are rotatable about an axis, comprising two ruler portions which are disposed at a right angle to each other.

The document 'VDI-Nachrichten' of 13th Apr. 1990 expresses the view that 'Computers are not yet replacing the drawing board'; investigation revealed serious deficiencies in regard to present CAD-systems, in particular weaknesses in terms of design, sketch drafting and data acquisition. Thus, in the case of complete redesigns, it is necessary to reckon on a clear additional expenditure of about 110% to 150%, in comparison with manual drafting.

Admittedly, the state of the art already includes digitizing systems with aiming devices which are movable on a bridge over the surface of the drawing board, such as magnifying glasses with a crosshair arrangement or the like, by virtue of which it is possible to go to points on a drawing and such points are passed by means of a digital transfer device to a computer for data acquisition.

However, with the so-called digitizers which are available on the market, it has been found that accurate drawing by hand (guiding a drawing pen or pencil or magnifying glass) is not possible, even with a ruler/template, in order reliably to hit the notional grid or pattern points with their tolerance zone (for example +/− 0.5 mm); for starting at the periphery of the tolerance zone results in slight overshoot or undershoot effects of for example 0.1 mm in relation to a line to be produced, so that it is not possible to get to the targeted point but the tolerance zone of the adjacent grid or pattern point is already affected. That then gives rise to a defective computer program input, which means that the described system is unusable for accurate technical drawings. Consequently, hitherto accurate inputs have been achieved only by virtue of co-ordinate point and/or distance information using a keyboard or a menu area on a table.

With knowledge of that state of the art, the inventor set himself the aim of improving the manual production of technical drawings and providing for that purpose support and conservation by means of data processing apparatus.

The invention further seeks to simplify further work on intermediate plots, lettering and labelling, and the storage of data.

SUMMARY OF THE INVENTION

That object is attained by the teachings of the independent claims; the appendant claims set forth particularly desirable additional configurations.

With a non-active substrate, by tracing contours of the computer-readable template/ruler with a drawing pen or pencil or by touching the starting point, contour drawing or tracing a contour region and touching an end point of a previously traced ruler or template contour, it is possible for same to be used virtually at the same time as a computer input. In contrast to this invention, in known large-format drawing installations—as indicated above—it is only possible to digitize something which has already been drawn by subsequently moving to same with a crosshair magnifying glass, which presupposes an approach movement (displacement of the drawing rulers/drawing head/drawing templates) and thus prevents smooth fast drawing or digitization.

In the drawing apparatus according to the invention, the drawing operation is rationalized as the drawing rulers/templates do not have to be changed in regard to their position for computer input or, and input is effected at the drawing edge or the immediate vicinity thereof; the operating surfaces, for example the keyboards, are only a few millimeters away from the location of the drawing operation and the ball of the thumb of the hand of the draftsman does not need to lift off the drawing surface for the purposes of computer/program operating inputs. The drawing rulers/templates according to the invention are combined in particular on carriage-type machines, in particular with electrical measuring devices, on parallel machines, with or without a drawing head position measuring device, on drawing boards, in particular with an electrical slider position measuring device, or a special digitisation board, but in accordance with the invention they can also be used freely movably in space on any substrates for drawing/measuring purposes and they can communicate for computation to a computer the necessary position data in respect of the computer-readable ruler/templates.

In accordance with the invention the drawing aid or the pen or pencil or pair of compasses is connected to a data receiving machine and is adapted to be activatable by the respective other partner for data output. A further solution provides that the drawing aid has associated therewith at least one digitization plane, with the interposition of the drawing surface, and data transfer can be activated at the meeting point of the drawing aid with the pen or pencil or compasses or the like.

In accordance with further features of the invention the digitization plane is possibly subdivided into a plurality of areas and/or the drawing surface is provided with light corners and grid lines connecting same.

It has also been found desirable for the element which is adapted to be activatable to be provided with at least one switch member for limiting activation, that is to say to control the sensitivity of the data-transmitting member so that it responds only within desired time limits.

Advantageously, the drawing aid—that is to say the ruler or the template—is to have at least one picture screen associated therewith, or at least one picture screen to be integrated into the drawing aid.

The use of computer-readable rulers/templates or the like drawing aids means that it is possible to achieve accurate distance information in regard to existing points—similar to a keyboard/menu input—, while at the same time that gives the large-format drawing which is distinguished by its clarity.

In the drawing apparatus according to the invention, computer and program instructions can be initiated on an active and a non-active surface by means of the computer-readable drawing aids, the rulers/templates, and operating or control panels associated or integrated therewith, and at the same time components of the drawing can be produced.

Preferably, at least one small-format flat screen and/or at least one LCD or liquid crystal display is integrated in the drawing aid in the immediate vicinity of the or directly at a drawing edge. Likewise certain switches/menu panels or areas, with lamp signals, can indicate the switching condition thereof.

The drawing apparatus according to the invention is supplemented by an active sector surface, which is adapted to be switched on, of the total drawing surface, which makes it possible additionally to use partial regions of the drawing surface, with normal drawing templates, in which respect a pen or pencil is used to trace along the corresponding contours thereof and same are thus read into the computer.

It has proven to be advantageous to draw manually circles and parts of circles on the active surface of that kind, by means of a special pair of compasses, and also to draw circles and parts of circles on a non-active surface by another configuration of compasses according to the invention, and also to input same into the computer.

Therefore, with the drawing apparatus according to the invention, contours are followed along contours of the ruler-like or drawing template-like drawing aids, using drawing implements or devices, not only on an active but also on a non-active surface (digitizer), and they permit access to computer and program instructions by the actuation of switches—or for example sectors of an active sensor surface with menu provision—in the immediate vicinity of or on the actual contour edge. Ruler/template contours which are followed in that way are drawn both on the drawing support such as paper or film or foil and also at the same time passed to a computer program, possibly also in a sector-wise manner and for example with a time delay or after intermediate storage. Input is effected by the drawing pen or pencil itself when going along the ruler/template contour directly or on the ruler/template surface in the vicinity of the guide edge by way of the active surface or by way of the switches which are disposed in side-by-side relationship at fixed spacings.

When producing drawings, the templates can be operated individually or in groups insofar as they are laid together or connected together by means of cables in order to transmit data to a computer installation directly or after intermediate storage.

Also in accordance with the invention is a pair of digitization compasses which can be used to draw circles and parts of circles over an active surface but which can pass the traced drawing contour to a computer/program by means of the active surface by compass tip registration. The pair of digitizing compasses can also have at the tips thereof a device by means of which the compasses can measure the compasses position in a co-ordinate system on any substrate, and in addition the drawing radius can be measured. The two items of measurable data are passed to a computer/program and permit detection of the traced drawing contour.

As already mentioned, by virtue of these steps, it is possible in conventional manner to operate with drawing rulers and templates on the drawing apparatus and nonetheless effect computer programming of what is dragon in a rational and accurate manner at the same time as the drawing produced with the drawing pen or pencil or the like. At the same time the system provides for simple operation with computer installations/programs, in particular in the field of graphic, drawing and design offices as the drawing operation can be carried out in the usual manner by the draftsman without particular re-adaptation, using only slightly modified equipment such as rulers, templates and compasses, while data are fed to the connected computer installation at the same time in a manner which is almost unnoticeable to the draftsman.

For the purposes of better monitoring of the computer inputs, drawing surfaces represented on the computer screen are clearly delimited on the drawing surface of the drawing apparatus by a sector indication by means of lamps or diodes, the above-mentioned light corners.

Drawings, or parts thereof, which are already present in a computer installation, after they have been plotted out, can be set up on the drawing surface and added to or altered with the drawing apparatus.

The drawing apparatus according to the invention therefore provides for a novel program input or a novel computer/program dialogue and attains the object specified by the inventor in a delightful fashion.

BRIEF DESCRIPTION OF THE DRAWINGS

Further advantages, features and details of the invention will be apparent from the following description of preferred embodiments and with reference to the drawings in which:

FIGS. 33, 33*a*, 33*b* and 34 are perspective views of parts of the machine with guide edges, FIGS. 35 to 38 are views in section through FIGS. 33, 33*a* and 33*b* taken along lines XXXV—XXXVIII therein, and diagrammatic perspective views associated with each thereof, FIG. 39 is a view in section through FIG. 34 taken along line XXXIX—XXXIX thereof, and FIG. 40 is a perspective view of another embodiment in respect of sectional FIG. 39.

DETAILED DESCRIPTION OF THE PREFERRED EMBODIMENT

Figure 1:
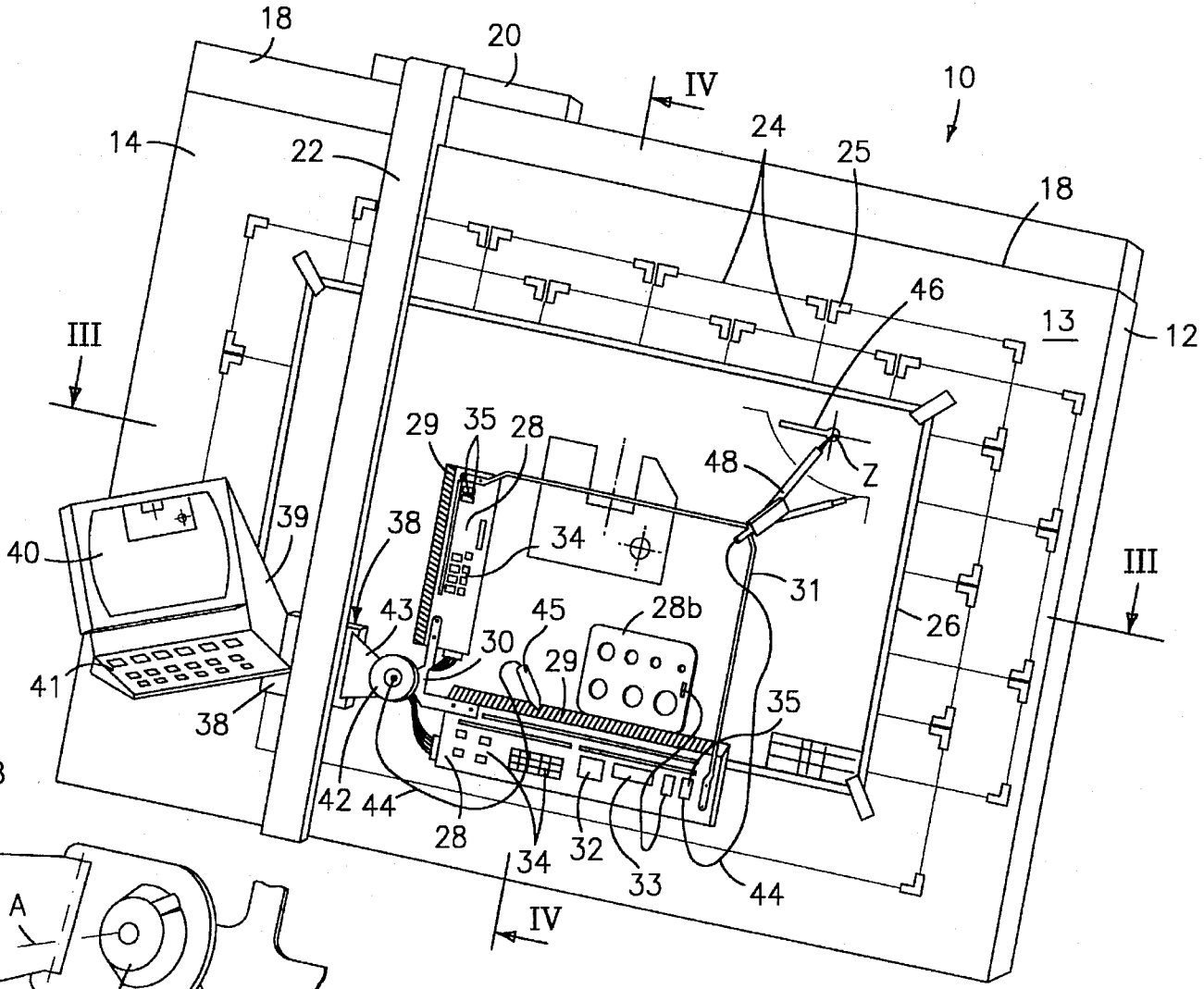
FIG. 1 is a perspective view of a drawing machine with a detail picked out on a larger scale.
Figure 1A:
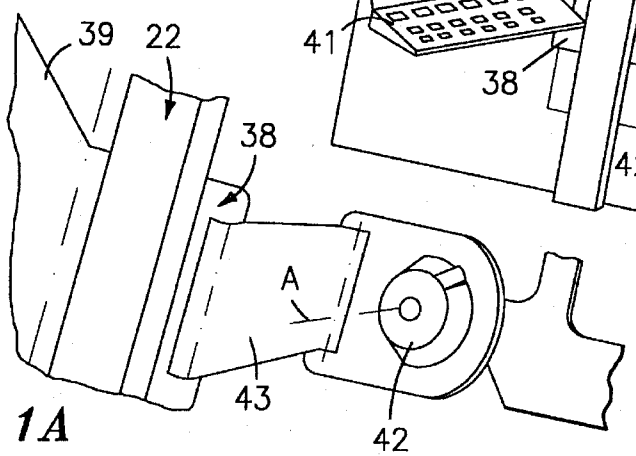
Figure 4:
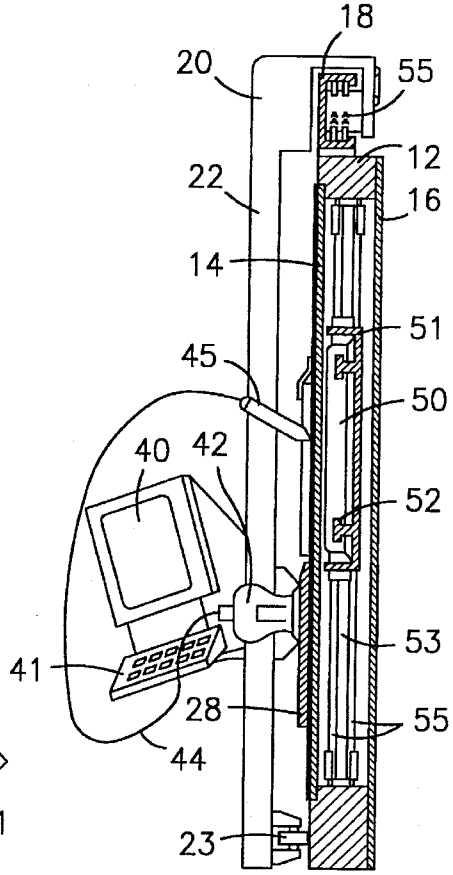
FIG. 4 is a view in vertical section through FIG. 1 taken along line IV—IV therein on an enlarged scale.
Figure 3:
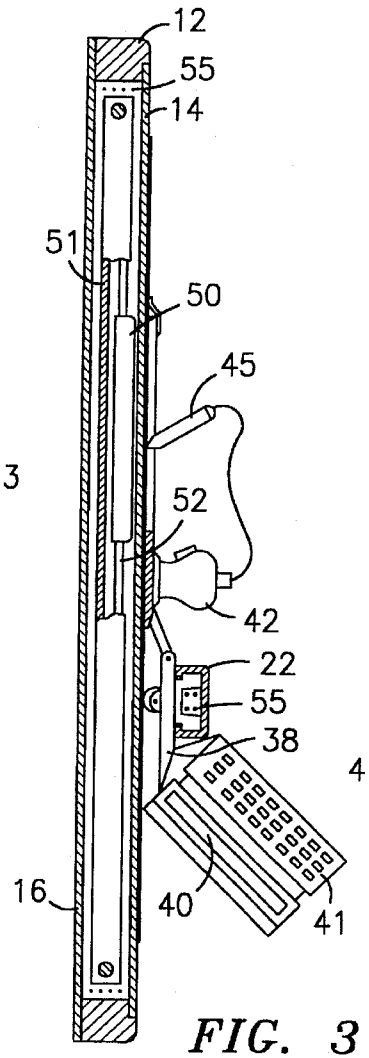
FIG. 3 is a view in longitudinal section through FIG. 1 taken along line III—III therein on an enlarged scale.

A drawing apparatus 10 has, on an equipment frame 12, a main plate or board 14 with which there is associated a back plate or board 16 at a spacing a, forming an internal space 15. Extending at the upper edge of the plate or board is a rail 18 for a carriage 20 which is slidable parallel to the surface 13 of the plate or board, including a bridge 22 which projects from the carriage 20 over the surface 13 and which has a travel roller 23 towards its end. The surface 13 is provided with grid lines 24 and light corners 25 which are let in flush.

The contour 26 indicates a piece of drawing paper which is glued on to the board surface 13 and disposed over same at the center of the main plate or board 14 are two rectangular keyboard housings 28 which provide rulers 29 and which are joined together at a right angle by means of an angle bar 30—at the left in FIG. 1—and by a boundary or angle loop 31—at the right in FIG. 1. Disposed on at least one of the keyboard housings 28 are a small screen, as identified at 32, a digit/letter display as indicated at 33, as well as rows of switches as indicated at 34 and plug jacks as indicated at 35.

Mounted on the bridge 22 is a slide shoe 38 which is displaceable therealong and which has a pivotally mounted connecting portion 39 for a large-format screen 40 and a control or operating panel 41 and on the other hand a handle 42 on a hinge plate 43 which is pivotally connected on both sides and from which a signal cable 44 is taken to a sensor drawing pen or pencil 45. The boundary loop 31 is here pivotable about an axis of rotation A.

Fitted on the main plate or board 14 above the boundary loop 31 is a leg pivot point plate 46 for an electrical pair of compasses 48 which contacts same in the compass pivot point Z.

Figure 2:
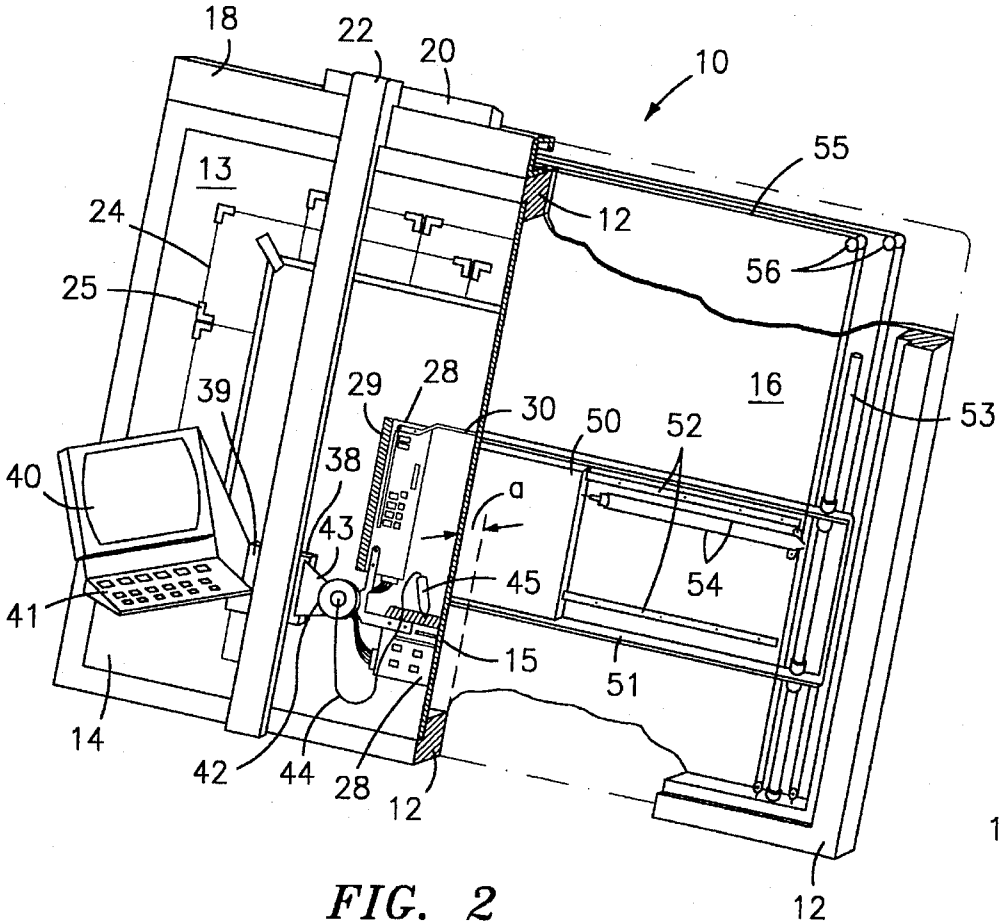
FIG. 2 is a partly sectional view of the drawing machine.
Figure 8:
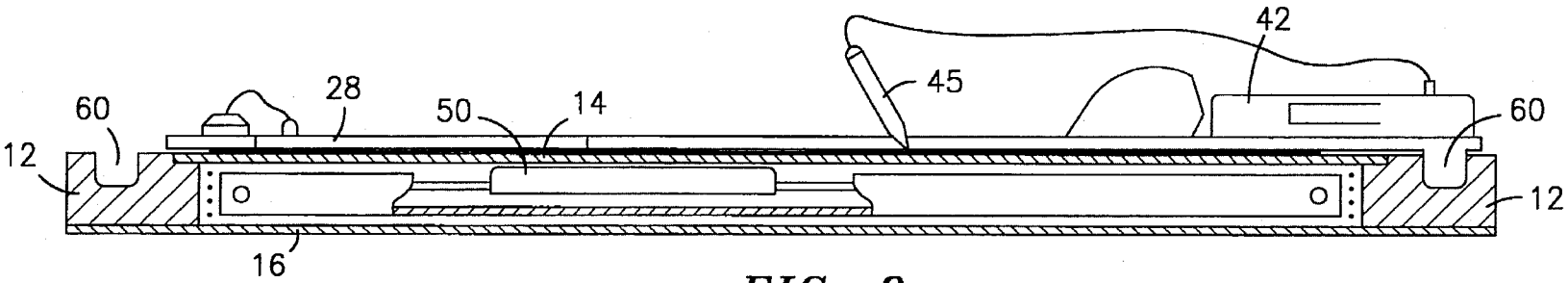
FIG. 8 is a view in cross-section through FIG. 6 taken along line VIII—VIII thereof.

In particular FIG. 2 shows beneath the main plate or board 14 on the back plate or board 16 a second plane as a digitization surface 50 on a carriage 51 which has horizontal travel rails 52 and which itself can be displaced vertically on guide members 53, mounted on the frame structure 12 of the apparatus. At 54 and 55 cable arrangements pass around cable rollers 56 for controlling the digitization surface 50 and the carriage 51 respectively.

Figure 5:
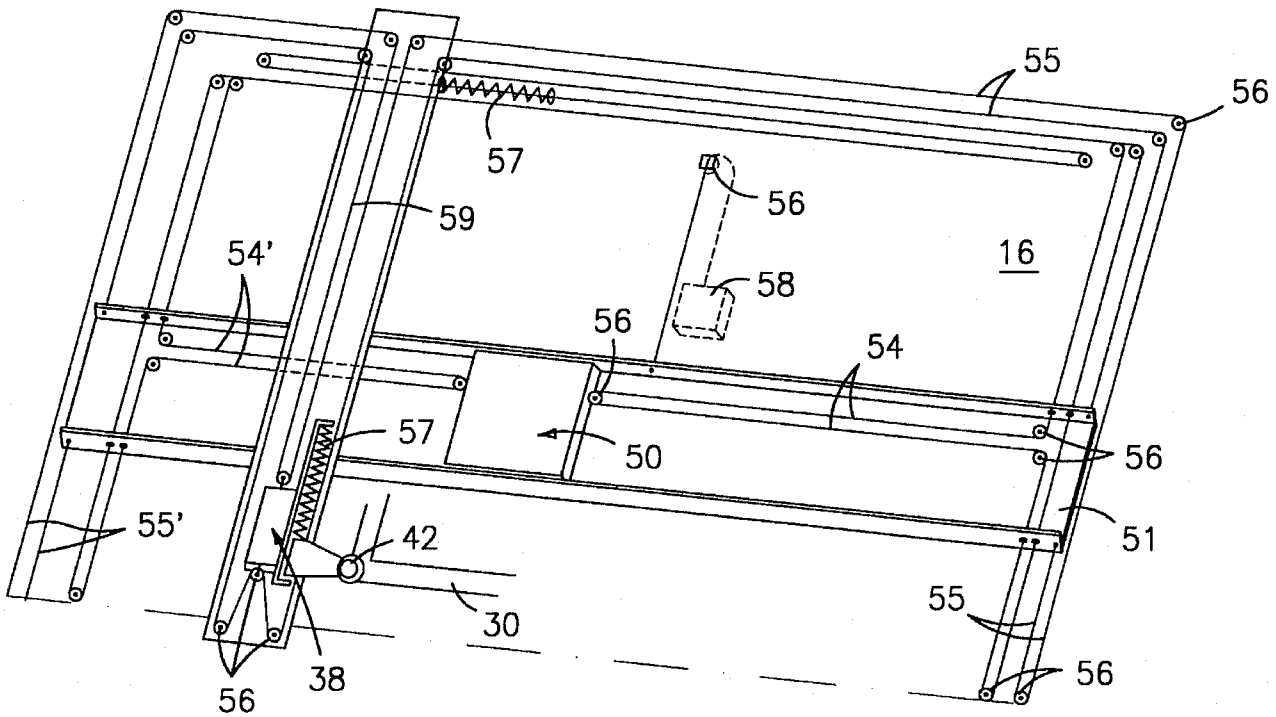
FIG. 5 is a diagrammatic view of cable arrangements in the drawing machine.
Figure 7:
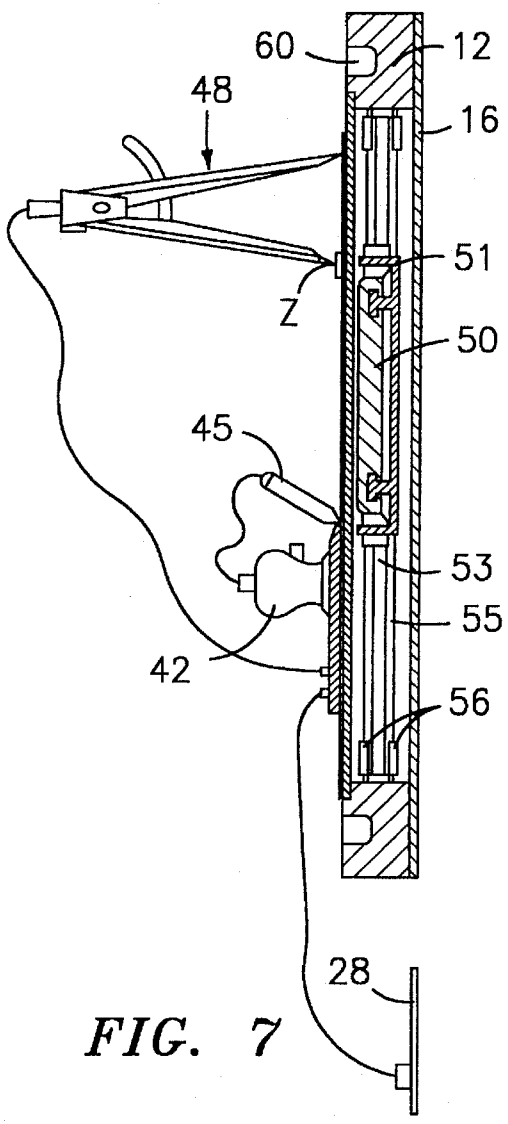

The cable arrangements 54, 55 and 54', 55' (FIG. 5) respectively and their cable rollers 56 can be seen in particular in FIG. 5. It will be seen that—with the interposition of force storage means such as compression springs 57 or the like, they move both the digitization plane 50 horizontally and also the carriage 51 thereof vertically, against neutralization weights 58. Further cable arrangements 59 engage the slide shoe 38 and control the movement thereof along the bridge 22.

Figure 6:
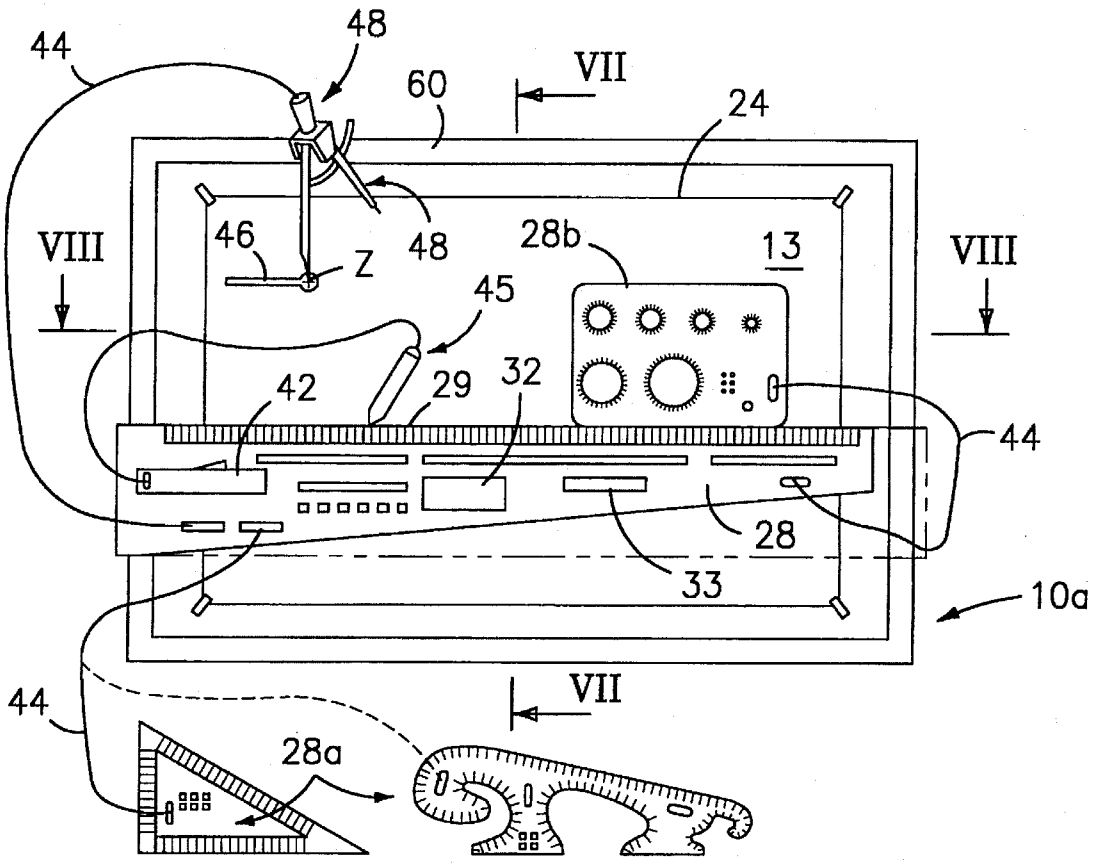
FIG. 6 is a plan view of parts of a drawing machine which can be disposed directly on a table top or the like, FIG. 7 is a view in vertical section through FIG. 6 taken along line VII—VII thereof on an enlarged scale.
Figure 10:
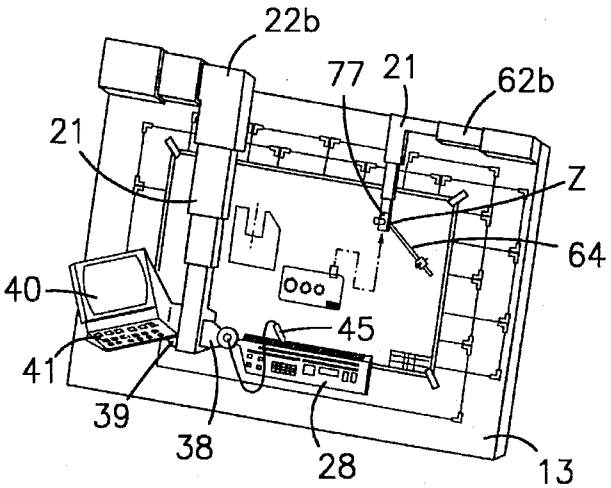
Figure 9:
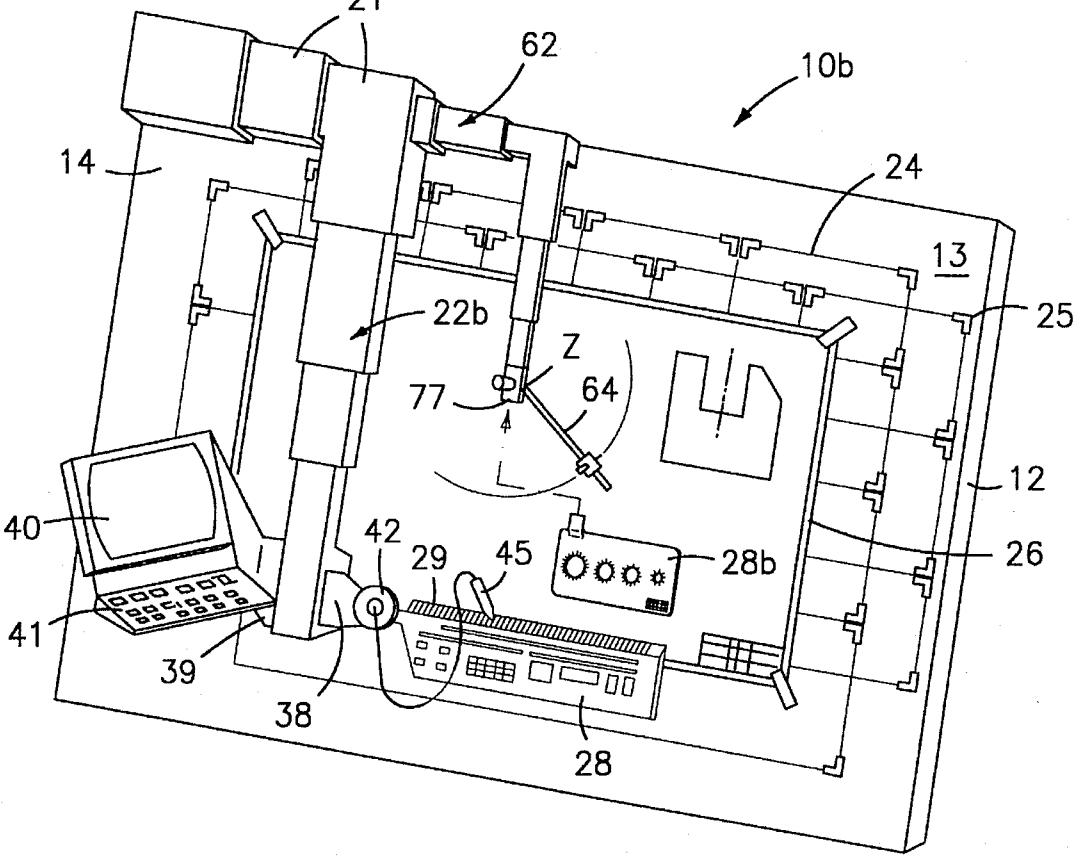

Another embodiment 10*a* of the drawing machine, as shown in FIG. 6, clearly shows in particular guide paths 60 as well as configurations of the keyboard housings 28*a* in the form of a triangle, curved rulers or templates 28*b*. FIGS. 9 and 10 show telescopic bridges 22*b* which can be extended or contracted in two co-ordinates by virtue of a plurality of interengaging extension members 21, and, in the case of FIG. 9, have additional support arms 62—which in turn are variable in length—for a compass arm 64 which is pivotable about the pivot point Z, while FIG. 10 shows a support arm 62*b*, which is separate from the bridge 22*b*, for the compass arm 64.

Figure 11:
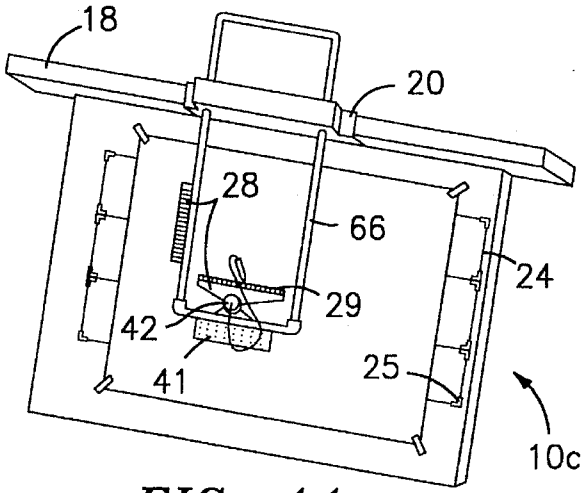
FIGS. 9 to 11 are perspective views of further embodiments of drawing machines, FIGS. 10 and 11 being on a smaller scale than FIG. 9, FIGS. 12 to 14 are diagrammatic views of support arms for drawing machines.

FIG. 11 shows a simple configuration 10*c* with an instrument group which is horizontally displaceable on a travel frame 66 of the carriage 20; the keyboard housing 28 is here provided on both sides of a power supply socket 67 and faces with its ruler bar 29 upwards.

Figure 13:
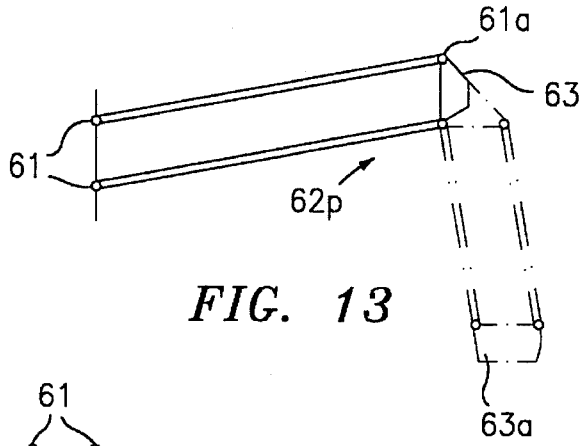
Figure 12:
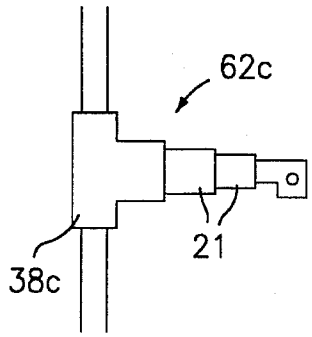
Figure 14:
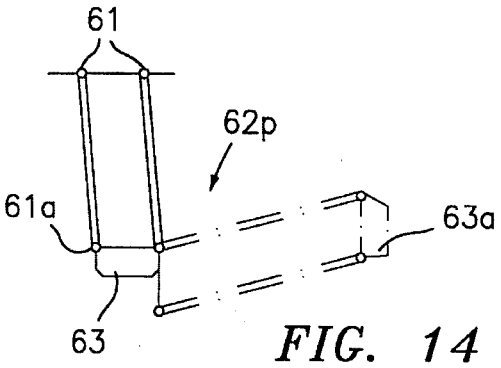

Instead of the support arms 62, 62*b* in FIGS. 9 and 10 of a telescopic configuration, as shown in FIG. 12 support arms 62*c* may also be of a partially telescopic configuration and may be connected to a carriage 38*c*, or it is possible to provide parallel guidance systems with a parallelogram holder 62*p*, as is shown in FIGS. 13 and 14, each having a double arm which is fixed at one end at the pivot point 61 and which carries a plate 63 suspended at further pivot points 61*a*. In other versions, the pivot points are so designed that the arms can be jointly synchronously displaced or varied in respect of their length. The dash-dotted configuration shows a system which is lengthened and whose arms pivotably guide the plate 63*a* at the pivot points 61*a*.

Figure 17:
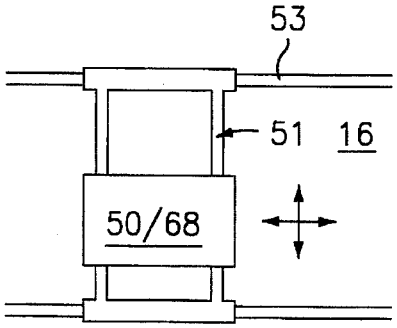
FIGS. 15 to 18 are diagrammatic plan views of carriage-like parts of the apparatus.
Figure 15:
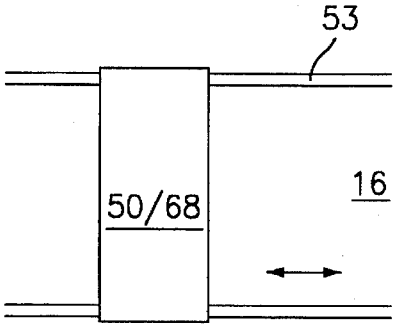
Figure 18:
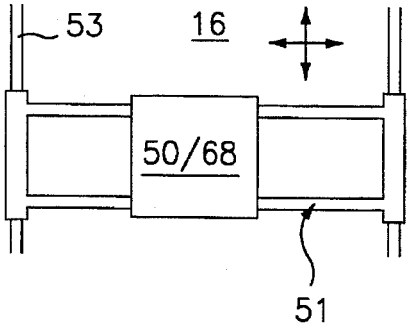
Figure 16:
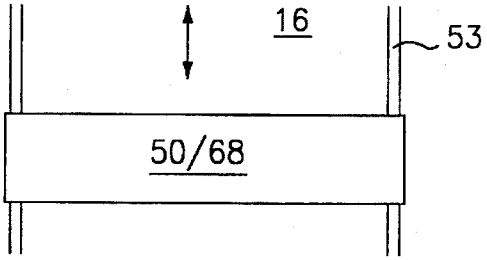

FIGS. 15 to 18 show various guide means for the digitization plane 50 or sensor surfaces 68, the digitization plane 50 being part of a carriage 51 in FIGS. 17 and 18.

Figure 19:
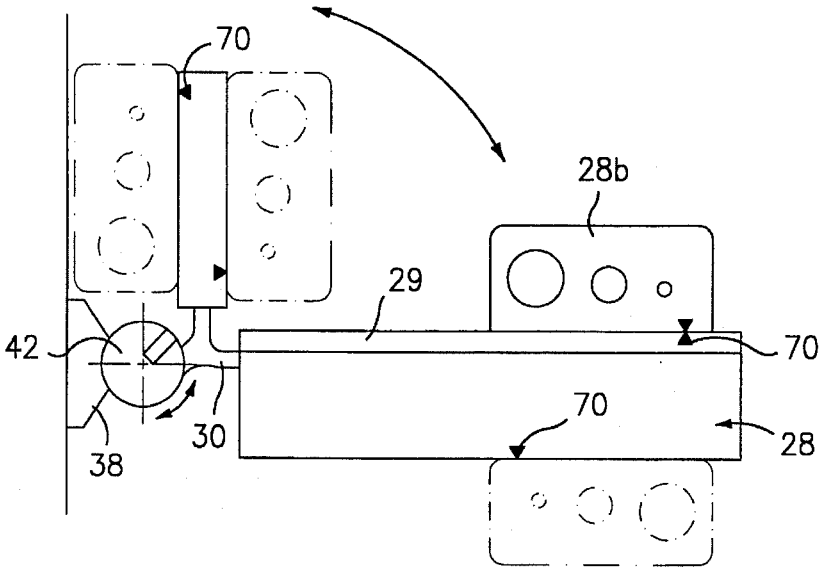
FIGS. 19 to 21 are plan views on an enlarged scale of details from FIG. 1.
Figure 20:
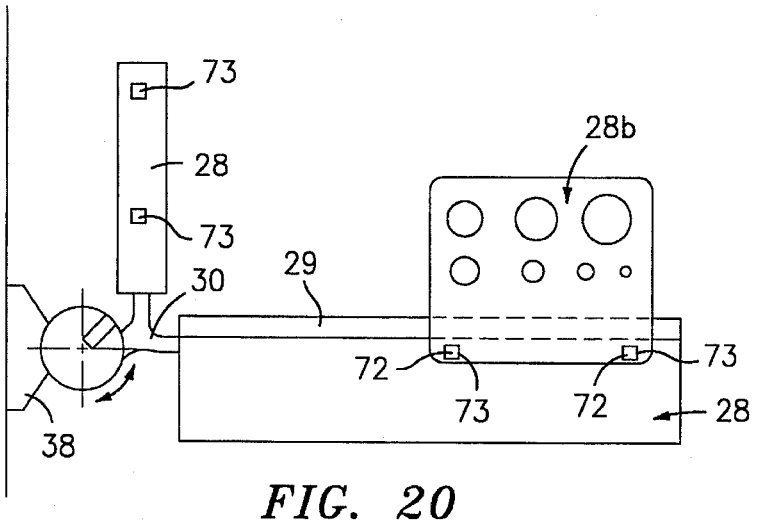
Figure 21:
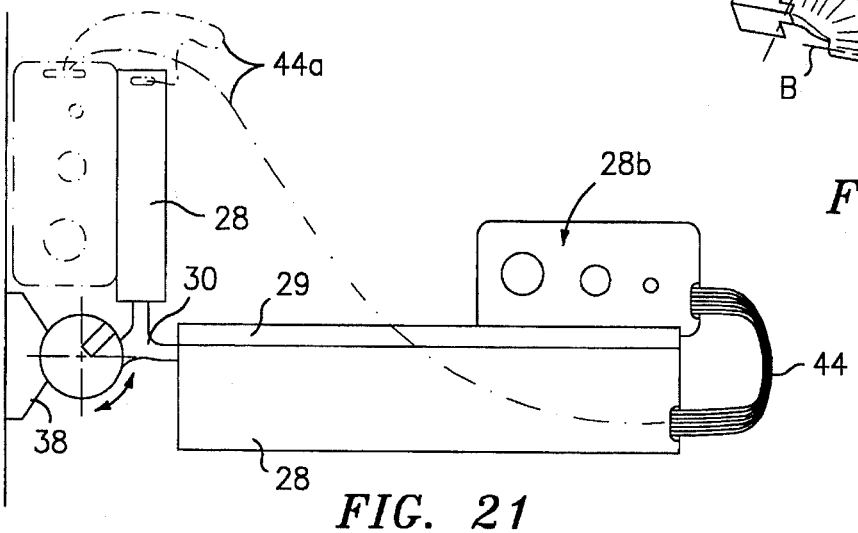

To provide a clear view, FIGS. 19 to 21 show a view on an enlarged scale of a part of FIGS. 1 and 2, showing in each case two rectangular keyboard housings 28 in front of the main plate or board 14 which is disposed in the plane of the drawing, wherein associated with at least one keyboard housing 28 or the adjusting means 70 thereof is an additional keyboard in the form of a template 28*b* which is only indicated. Electrical connections can be made with cables 44*a* or by way of direct plug-in connections of the additional keyboard 28*b* with plugs 72 in plug sockets 73 in keyboard housings 28, that is to say in a cable-free manner. The assembly 28, 30, 38, 42 is also pivotable in the direction indicated by the arrow about the handle 42.

Figure 22:
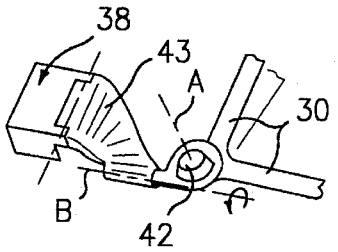
FIG. 22 is a perspective view of a pivotal holding device.

FIG. 22 in particular clearly shows that the keyboard housings 28 can be mounted for example rotatably in the center—axis of rotation A—of the handle 42 and can thus be adjustable; they then permit pivotal movement over the surface 13.

On the other hand, with the slide shoe 38, they are to be lifted off the surface 13 along a circular path about the axis B, over a constant angle, by way of a single-pivot or double-pivot plate.

Figure 24:
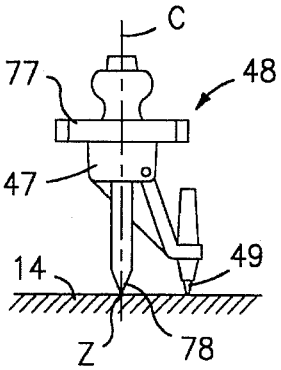
FIGS. 24 to 27 are side views of details from FIGS. 1 and 9 respectively on an enlarged scale.
Figure 25:
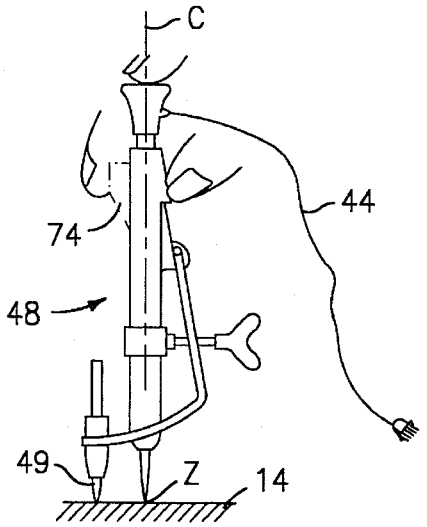
Figure 23:
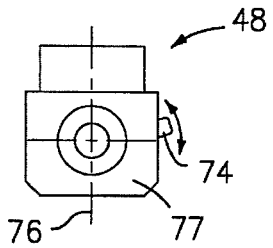
FIG. 23 is a plan view of a pair of compasses.
Figure 26:
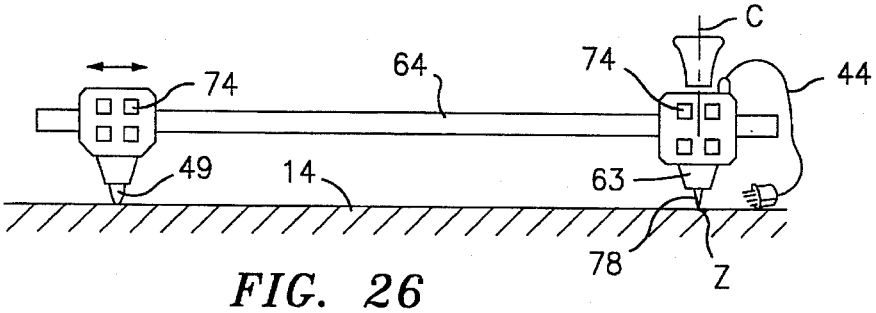
Figure 27:
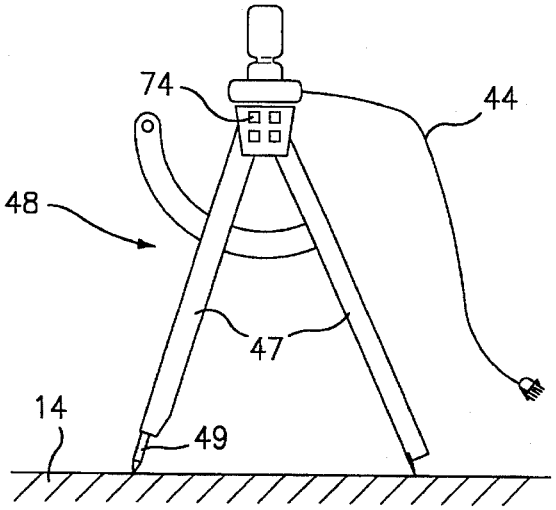

The digitized compasses 48 or compass arms 64 in FIGS. 23 to 25 are equipped with signal cables 44, while their active tips 49 which are rotatable about an axis C have contact elements. Radially or axially actuable switches 74 are provided for control purposes.

FIGS. 23 and 24 show a plan view and a side view of a pair of compasses, as used in the constructions shown in FIGS. 9 and 10. The position of the compasses relative to a co-ordinate zero line 76 which passes through the axis of rotation A is measured at the compass shaft 47 relative to a plate-like collar portion 74 on the compasses.

Reference numeral 78 identifies an orientation device which is of a needle-like configuration or which is in the form of a magnifying glass.

Figure 30:
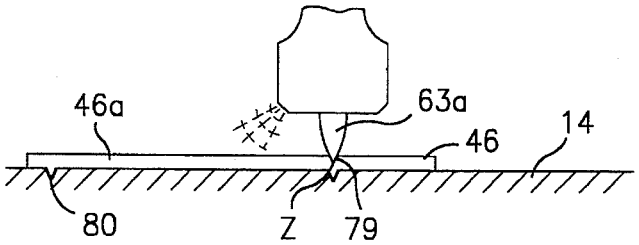
FIGS. 30 to 32 show views in section through FIG. 28 taken along line XXX—XXXII thereof.
Figure 31:
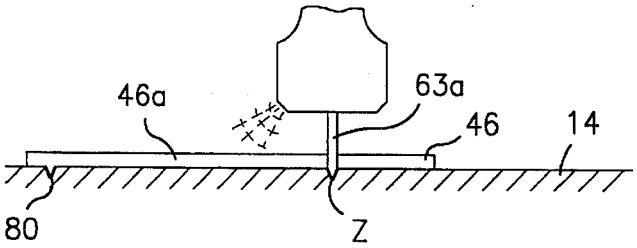
Figure 32:
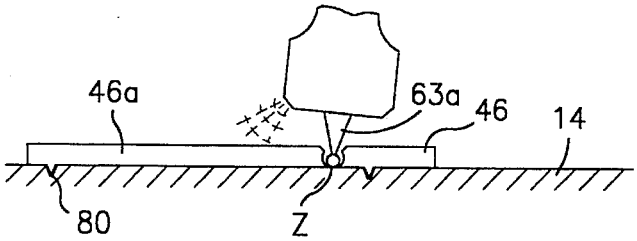
Figure 28:
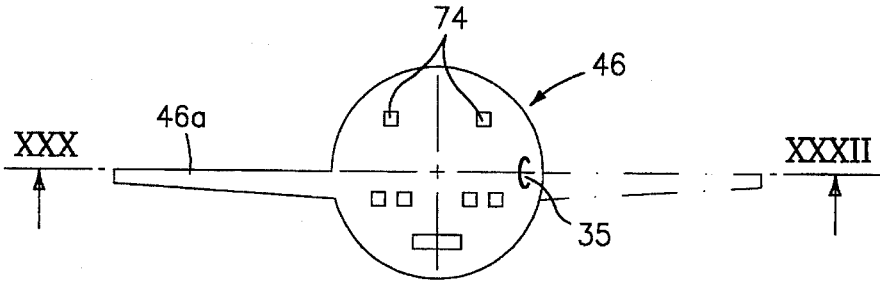
FIG. 28 is a plan view on an enlarged scale of a leg pivot point plate from FIG. 1.
Figure 29:
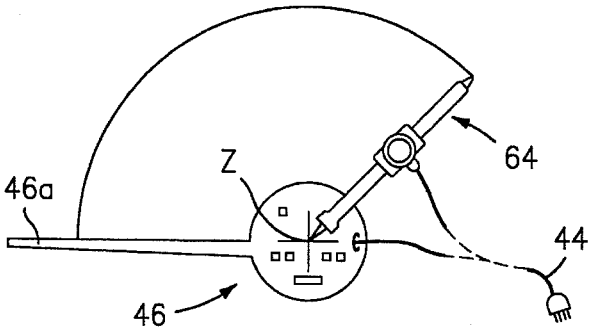
FIG. 29 shows the leg pivot point plate in FIG. 28 in another operating position, on a reduced scale.

The leg pivot point plate 46 described in relation to FIG. 1 is clearly illustrated in FIGS. 28 to 32, in particular the design configuration at the pivot point Z. The plate 46 can be completely round or it can be provided with one or more legs 46*a*, and involve switches 74 and plug jacks 35. Its support surface is slip-resistant, possibly being provided with one or more needle tips 80. The following alternative configurations are illustrated:

having a depression 79 into which is inserted a nose 63*a* on the compasses (FIG. 30);

the nose 63*a* passes through the leg pivot point plate 46 into the support surface member 14 (FIG. 31);

the leg pivot point plate 46 becomes a component of the compasses 48, in form-locking or positive relationship (FIG. 32).

Finally, FIGS. 33, 33*a*, 33*b* and 34 show perspective views of guide edges 82 in relation to particular configurations for contact-making purposes, and the subsequent Figures are sectional views thereof; FIG. 34 shows switch knobs 84 provided at the guide edge 82, which are actuated approximately parallel to the support surface 13 or the main plate or board 14, as is also the case with the covered sensor members 85 in FIG. 36. The active surfaces of the switch knobs 84*a* or the sensor surfaces 86*a* in FIGS. 37 and 38 are disposed perpendicularly and inclinedly respectively relative to the support surface 13, key elements 87 are provided for actuation of the switch knobs 84*a*, and both are actuated approximately perpendicularly to the support surface 13.

In the case of the guide pairing 82/82 diagrammatically shown in FIG. 34, two guide edges 82 define a guide gap 83, while FIG. 39 shows a view in cross-section thereof, showing sensor surfaces 86 with power supply paths or tracks. Moreover that cross-section also corresponds to the view on to a section edge, which is shown in FIG. 40, of a keyboard housing 28*c* which is U-shaped in plan view.

The drawing apparatus 10 according to the invention serves for the rational input of computer data in the preparation of drawings or for a clearer mode of operation when carrying out large-format work. It is possible to draw on a drawing surface in conventional manner and during the drawing operation the lines, curves and points are registered as input data in a computer which is not shown in the drawing for the sake of clarity. It can be seen from the description that the rulers and templates diagrammatically shown in the drawing are of a particular configuration for receiving such data and permit the accurate input of distances and other parameters.

What is claimed is:

1. An apparatus for making a drawing on a drawing carrier, said apparatus comprising:

a drawing surface for temporarily accommodating said drawing carrier;

a drawing device for producing points and lines on said drawing carrier;

a data receiving machine;

a movable drawing aid provided adjacent said drawing surface and displaceable over the drawing surface;

said movable drawing aid being connected to said data receiving machine and having a guide edge along which there is arranged a plurality of contact switches in a row, and said contact switches being actuated by said drawing device for outputting data used for creating a drawing to said data receiving machine.

2. The apparatus according to claim 1, further comprising a movable digitization plane positioned adjacent the drawing surface, wherein the digitization plane is movable along with the movable drawing aid and data transfer is caused where the drawing device and drawing aid meet.

3. The apparatus according to claim 2, wherein the digitization plane is divided into a plurality of areas and is connected to and movable by a drive member.

4. The apparatus according to claim 1, wherein the drawing surface is provided with light corners and grid lines connecting same.

5. The apparatus according to claim 1, wherein the drawing aid is connected with at least one picture screen.

6. The apparatus according to claim 1, wherein the drawing aid includes at least one picture screen integrated therein.

7. The apparatus according to claim 1 further comprising a bridge which is movable relative to the drawing surface and which engages the drawing surface, wherein the bridge includes at least one slide shoe as a carrier for the drawing aid, the slide shoe being displaceable on the bridge.

8. The apparatus according to claim 7, wherein the drawing aid comprises two ruler devices which are fixed rotatably and positioned at an angle relative to each other on the slide shoe, at least one ruler device being in the form of a keyboard housing.

9. The apparatus according to claim 7, wherein the slide shoe is connected by a signal cable to the drawing aid.

10. The apparatus according to claim 8, wherein the slide shoe has a handle with an axis and the two ruler devices are :rotatable both about the axis of the handle and about an axis extending at an angle to the axis of the handle.

11. The apparatus according to claim 7, wherein the slide shoe is connected to drive members.

12. The apparatus according to claim 11, wherein the drive members are cables.

13. The apparatus according to claim 7, wherein the bridge is connected to and movable by a drive member.

14. The apparatus according to claim 2, wherein the digitization plane is mounted movably in a carriage and the carriage is displaceable relative to the drawing surface.

15. The apparatus according to claim 3, further comprising a main plate and a back plate spaced from the main plate, wherein the main plate forms the drawing surface and the main and back plates define a receiving space for placement of the digitization plane and drive members.

16. The apparatus according to claim 7, wherein the bridge is variable in length.

17. The apparatus according to claim 16, wherein the bridge is variable in length in two coordinates.

18. The apparatus according to claim 1 wherein said plurality of contact switches extend at a spacing relative to the guide edge.

19. The apparatus according to claim 1, wherein the drawing aid includes a scale on the surface thereof adjacent the guide edge, wherein the guide edge is configured for engagement with the drawing device.

20. The apparatus according to claim 1, wherein the plurality of switches are substantially equally spaced along the guide edge, and wherein each of the switches is comprised of a microswitch adopted to be in data communication with the data receiving machine upon activation of the same by the drawing device.

21. The apparatus accounting to claim 1, wherein the drawing device has a sensor tip.

22. The apparatus according to claim 1, wherein the drawing device comprises a pair of compasses each having an insertion tip and a sensor tip.

23. The apparatus according to claim 22, wherein the drawing aid is comprised of a leg pivot point plate adapted to receive an insertion tip.

24. The apparatus according to claim 22 further comprising an orientation means arranged at the insertion tip.

25. An apparatus for making a drawing on a drawing carrier, said apparatus comprising:

a drawing surface for temporarily accommodating said drawing carrier;

a drawing device for producing points and lines on said drawing carrier;

a data receiving machine;

a movable drawing aid provided adjacent said drawing surface and displaceable over the drawing surface;

said movable drawing aid being connected to said data receiving machine and comprising means for being activated by said drawing device to output data used for creating a drawing to said data receiving machine;

said means for being activated by said drawing device comprising a movable digitization plane positioned adjacent said drawing surface, and said digitization plane being movable along with said movable drawing aid with data transfer being caused where said drawing device and said drawing aid meet.

26. An apparatus for making a drawing on a drawing carrier, said apparatus comprising:

a drawing surface for temporarily accommodating said drawing carrier;

a drawing device for producing points and lines on said drawing carrier;

a data receiving machine;

a movable drawing aid provided adjacent said drawing surface and displaceable over the drawing surface;

said movable drawing aid being connected to said data receiving machine and comprising means for being activated by said drawing device to output data used for creating a drawing to said data receiving machine; and said drawing device comprising a pair of compasses having an insertion tip and a sensor tip.

* * * * *